US005772209A

United States Patent [19]

Thompson

[11] Patent Number: 5,772,209

[45] Date of Patent: Jun. 30, 1998

[54] MATH GAME

[76] Inventor: Patrick A. Thompson, 2650 E. 32nd St., Suite 220, Joplin, Mo. 64804

[21] Appl. No.: 881,953

[22] Filed: Jun. 25, 1997

[51] Int. Cl.[6] ..... A63F 3/00

[52] U.S. Cl. ..... 273/268

[58] Field of Search ..... 273/243, 268, 273/271

[56] References Cited

U.S. PATENT DOCUMENTS

| | | | |
|---|---|---|---|
| 1,063,756 | 6/1913 | Wheatley | 273/271 |
| 1,238,522 | 8/1917 | Kalista | 273/268 X |
| 2,871,581 | 2/1959 | Guzak | 35/31 |
| 2,899,756 | 8/1959 | Wise | 35/31 |
| 3,111,320 | 11/1963 | Acosta | 273/271 |
| 3,342,493 | 9/1967 | Lang | 273/271 |
| 4,092,029 | 5/1978 | Jones | 273/271 |
| 4,139,199 | 2/1979 | Drummond | 273/271 X |
| 4,234,185 | 11/1980 | Alsip | 273/271 X |
| 4,360,347 | 11/1982 | Ghaznavi | 434/198 |
| 4,410,182 | 10/1983 | Francis | 273/268 |
| 4,561,658 | 12/1985 | Peterson | 273/243 |
| 4,720,108 | 1/1988 | Gramera | 273/271 X |
| 5,149,102 | 9/1992 | McGowan et al. | 273/258 |
| 5,314,190 | 5/1994 | Lyons | 273/272 |
| 5,366,226 | 11/1994 | McGowan et al. | 273/258 |
| 5,386,998 | 2/1995 | Mader et al. | 273/268 X |
| 5,445,390 | 8/1995 | Dutton et al. | 273/243 |
| 5,507,495 | 4/1996 | Kiss | 273/243 |

*Primary Examiner*—William E. Stoll
*Attorney, Agent, or Firm*—William R. Sharp

[57] ABSTRACT

A math game is described herein which can effectively improve one's math skills while being very entertaining. A game board has imprinted thereon a plurality of sections, where each section comprises a first set of integers assigned to a particular player. A player takes a turn by rolling a set of dice to obtain a second set of integers which are used in a math calculation to obtain a solution integer corresponding to an integer of the first set of integers within a predetermined period of time. The thus calculated solution integer can be indicated on the game board by covering it with a chip. The first player to successfully calculate all or a predetermined number of integers in his or her section is the winner of the game.

11 Claims, 1 Drawing Sheet

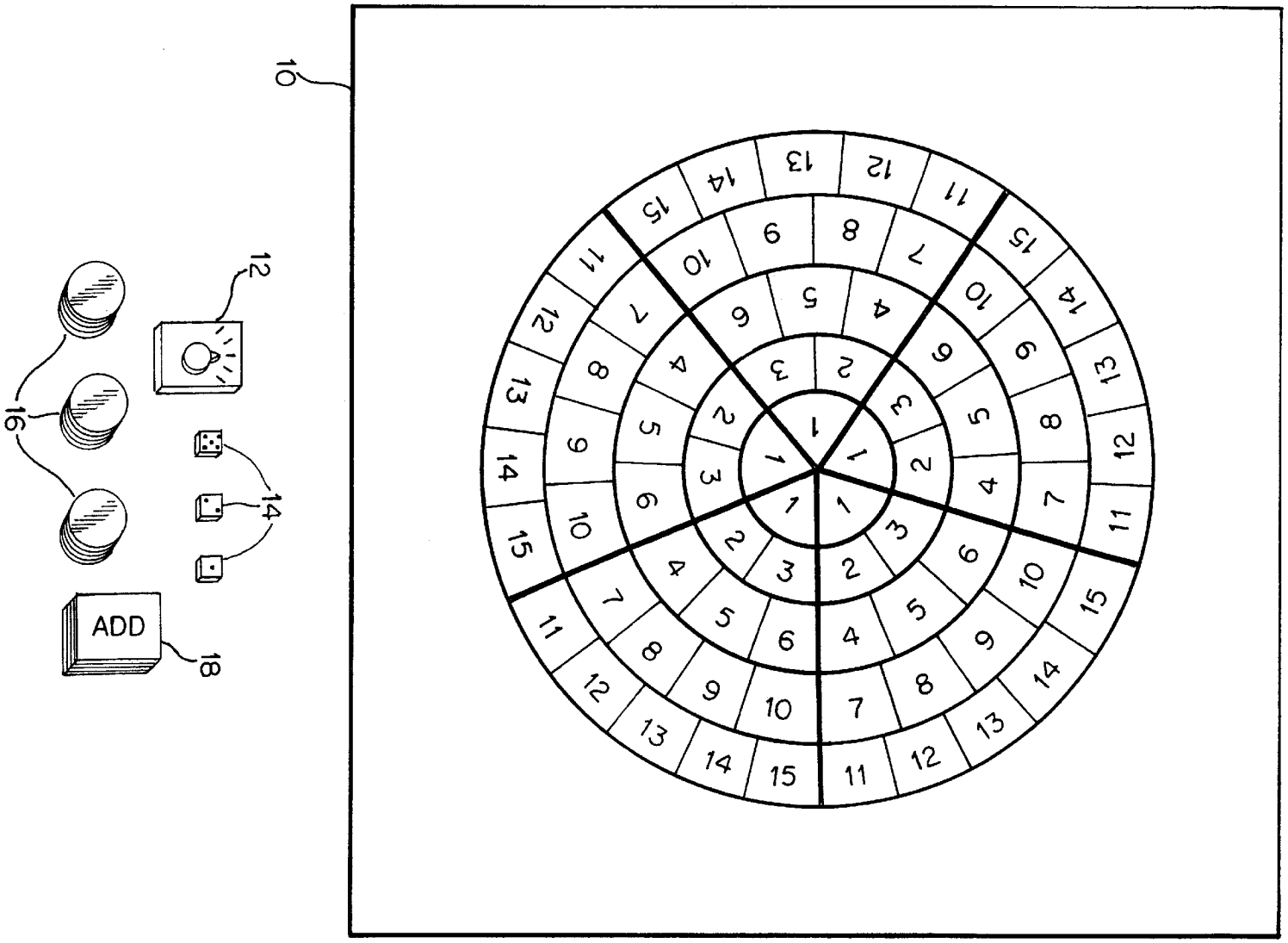
10
12
14
16
18
ADD

MATH GAME

BACKGROUND OF THE INVENTION

The invention relates to games and more particularly to games employing mathematics.

Improving one's math skills is certainly a desirable objective, particularly for children attending school and learning the various math functions for the first time. It would be desirable to improve math skills in a way which is both effective and entertaining.

SUMMARY OF THE INVENTION

It is, therefore, an object of the invention to provide a math game which is both instructive and entertaining.

The above object is realized by a math game comprising: a game board having imprinted thereon a plurality of sections, wherein each section comprises a first set of integers assigned to a particular player; a timer which can be set to a predetermined calculation time; a set of dice having indicia imprinted thereon representative of integers and rollable by each player to indicate a second set of integers employed by the player to calculate, using at least one math function within the predetermined calculation time, a solution integer corresponding to one integer of the first set of integers; indication means (such as chips) for indicating solution integers on the game board; wherein the first player to calculate all or a predetermined number of integers of his or her first set of integers is the winner of the game.

According to another aspect of the invention, there is provided a method of playing a math game comprising the steps of: (a) providing a game board having imprinted thereon a plurality of sections, wherein each section comprises a first set of integers assigned to a particular player; (b) providing a set of dice having indicia imprinted thereon representative of integers; (c) rolling the set of dice by a player so that the set of dice indicate a second set of integers; (d) calculating by the player, using the second set of integers and at least one math function within a predetermined calculation time, a solution integer corresponding to one integer of the first set of integers; (e) indicating on the game board the solution integer as calculated in step (d); and (f) repeating steps (c)–(e) for each player until one of the players successfully calculates each or a predetermined number of the integers of his or her first set of integers.

BRIEF DESCRIPTION OF THE DRAWING

The FIGURE shows the game board and other components of a preferred embodiment of the math game.

DETAILED DESCRIPTION OF THE INVENTION

A preferred embodiment of the invention will now be described with reference to the FIGURE. Components of the game include a game board 10, a timer 12, a set of three dice 14, chips 16, and a deck of cards 18.

Game board 10 has imprinted thereon a plurality of sections, in this case five sections, wherein each section comprises a set of integers 1–n where n is an integer. In the preferred embodiment n=15. As shown, the sections of game board 10 define a circle.

Timer 12 is capable of being set to a certain time period. After elapse of such time period the timer preferably emits a sound to indicate to the players that a player's turn is over. Timer 12 can be a mechanical timer with an internal buzzer or a digital timer for more accurate time settings.

Set of dice 14 can be standard dice with dots imprinted thereon as shown. Alternatively, the dice could have the actual integers imprinted thereon. Three dice are necessary in the preferred embodiment where n=15, but only two dice could be used if n is 12 or less. More than three dice could also be used, but this makes the game undesirably difficult.

Chips 16 should be large enough to cover integers on game board 10. A sufficient number of chips should be provided to enable play by up to five players.

Each of cards 18 has a math function imprinted thereon, namely, add, subtract, multiply, or divide. The number of cards is not particularly important, but several dozen cards is preferred.

Each player has an assigned section on game board 10 with the set of integers 1–15 therein. To start the game, each player rolls one die 14. The player with the highest roll starts first. Before each round of play (a round being a turn taken by each player) a card is drawn by one of the players from card deck 18. Calculations during such round must include the math function on the drawn card at least once. Play proceeds clockwise.

For a particular turn, a player rolls the set of dice 14 to obtain a set of three integers. Immediately after the roll, one of the other players sets timer 12 to a predetermined time period, preferably about 20 to about 60 seconds, depending upon the skill level of the players. The player has this time period in which to use the rolled set of integers to calculate a solution integer corresponding to an integer in his or her section. The math function on the drawn card and another math function (which can be the same as or different than the drawn math function) are employed in the calculation. Such calculation must be spoken outloud to the other players. For example, assuming the player rolls a 4, 5, and 6, and an add card is drawn for the round, the player could make the calculation 4+5+6 to obtain a solution integer of 15, or the player could make the calculation 4 +5−6 to obtain the solution integer 3. The solution integer in the player's section is covered by a chip 16. The player's turn is over once the solution integer is covered or if the player cannot calculate a solution integer corresponding to any uncovered integers in his or her section in the predetermined time period.

Some special rules of the game will now be described which can make the game more interesting. Under these special rules, removing a chip from a section ends a turn.

If a player rolls a triple (all three dice the same integer), the player has the option of (i) rolling again for another chance to calculate a solution integer, or (ii) removing a chip 16 from another player's section.

If a player rolls a 3, 1, and 4 (corresponding to the integers in pi, 3.14), this allows the player to skip the calculation and cover any integer in his or her section with a chip 16, or the player can remove a chip 16 from another player's section.

After a player makes a calculation, this can be challenged by another player. A showing that the calculation is incorrect allows removal of a chip 16 from the section of the player who made the incorrect calculation. If the calculation proves to be correct, the player making the calculation can remove a chip 16 from the challenger's section. Any challenge must be made before the next player rolls.

Play proceeds until one player wins by covering all integers 1–15 in his or her section with chips 16.

Obviously, many modifications and variations of the present invention are possible in light of the above teachings. Several variations are set forth below.

For younger players or for a faster game, one can choose to eliminate integers in the sections from play. For example, only 1–10 in each section could be used.

One can choose to not use the math function cards 18. According to such play, one math function could be required for use throughout the game. Or, any combination of math functions could be required throughout the game, such as addition and subtraction only, addition and division only, etc. Of course, it is also possible to play the game with no restrictions on what math functions can be used in the calculations.

To make the game more challenging, it could be required that each player calculate the integers of his or her section in sequence rather than in random order.

It is also possible to "handicap" the game to make it more even for players of various skill levels by using some of the above variations in different combinations. For example, a young player may use any of the math functions and only have to cover integers 1–10, while his older brother or sister could use all the functions but have to cover integers 1–15, while mom and dad have to cover all integers 1–15 and draw from the math function cards 18.

According to another variation, solution integers could be indicated on the game board by a means other than chips. For example, the game board could have a markable and erasable surface such that solution integers could be marked out, circled, etc. and then erased at the conclusion of the game.

That which is claimed is:

1. A method of playing a math game comprising the steps of:

(a) providing a game board having imprinted thereon a plurality of sections, wherein each section comprises a first set of integers assigned to a particular player and wherein the first set of integers comprises 1–n where n is an integer;

(b) providing a set of dice having indicia imprinted thereon representative of integers;

(c) rolling the set of dice by a player so that the set of dice indicate a second set of integers;

(d) calculating by the player, using the second set of integers and at least one math function within a predetermined calculation time, a single solution integer corresponding to one integer of the first set of integers;

(e) indicating on the game board the single solution integer as calculated in step (d); and (f) repeating steps (c)–(e) for each player until one of the players successfully calculates each or a predetermined number of the integers of his or her first set of integers.

2. A method of playing a math game as recited in claim 9 wherein the plurality of sections of the game board define a circle.

3. A method of playing a math game as recited in claim 2 wherein n is 15.

4. A method of playing a math game as recited in claim 3 wherein the predetermined calculation time is about 20 to about 60 seconds.

5. A method of playing a math game as recited in claim 4 wherein in (e) the single solution integer is indicated by covering it with a chip.

6. A method of playing a math game as recited in claim 5 further comprising drawing a math function card from a deck of math function cards, wherein each card has imprinted thereon a math function to be employed in the calculation.

7. A method of playing a math game as recited in claim 6 further comprising the step after (d) of challenging by another player the calculation made in (d), where a showing that the calculation is incorrect allows said another player to remove a chip from the player's section, and where the calculation proves to be correct the player may remove a chip from said another player's section.

8. A method of playing a math game comprising the steps of: (a) providing a game board having imprinted thereon a plurality of sections, wherein each section comprises a first set of integers assigned to a particular player;

(b) providing a set of three dice having indicia imprinted thereon representative of integers;

(c) rolling the set of dice by a player so that the set of dice indicate a second set of integers;

(d) calculating by the player, using the second set of integers and at least one math function within a predetermined calculation time, a solution integer corresponding to one integer of the first set of integers;

(e) indicating on the game board the solution integer as calculated in step (d); and (f) repeating steps (c)–(e) for each player until one of the players successfully calculates each or a predetermined number of the integers of his or her first set of integers.

9. A method of playing a math game as recited in claim 8 wherein the first set of integers comprises 1–n where n is an integer.

10. A method of playing a math game as recited in claim 9 wherein in (c), rolling a triple, all three dice the same integer, by the player gives the player the option of (i) rolling again for another chance to calculate a solution integer, or (ii) removing a chip from another player's section.

11. A method of playing a math game as recited in claim 10 wherein in (c), rolling a 3, 1, and 4 allows the player to skip (d) and cover an integer of his or her section or remove a chip from another player's section.

* * * * *

UNITED STATES PATENT AND TRADEMARK OFFICE

CERTIFICATE OF CORRECTION

PATENT NO. :5,772,209
DATED :June 30, 1998
INVENTOR(S) :Thompson

It is certified that error appears in the above-identified patent and that said Letters Patent is hereby corrected as shown below:

Column 3, claim 2, line 53, "9" should read –1--.

Signed and Sealed this

Twenty-second Day of September, 1998

*Attest:*

Bruce Lehman

BRUCE LEHMAN

*Attesting Officer*

*Commissioner of Patents and Trademarks*